US007414218B2

(12) United States Patent
Wheeler et al.

(10) Patent No.: US 7,414,218 B2
(45) Date of Patent: Aug. 19, 2008

(54) CROSS CIRCULATION MAIL SORTER STACKER DESIGN WITH DUAL PORTED INPUT, AND METHOD OF OPERATING THE SAME

(75) Inventors: William Wheeler, Sand Springs, OK (US); Willson L. Mayerberg, II, Skiatook, OK (US)

(73) Assignee: Lockheed Martin Corporation, Bethesda, MD (US)

( * ) Notice: Subject to any disclaimer, the term of this patent is extended or adjusted under 35 U.S.C. 154(b) by 453 days.

(21) Appl. No.: 10/918,601

(22) Filed: Aug. 16, 2004

(65) Prior Publication Data

US 2006/0037888 A1 Feb. 23, 2006

(51) Int. Cl.
*B07C 5/00* (2006.01)

(52) U.S. Cl. ..... 209/584; 209/583; 209/900; 198/457.03; 198/370.01

(58) Field of Classification Search ..... 209/583, 209/584, 900; 198/347.4, 368, 369.1, 370.01, 198/370.07, 418.1, 418.2, 427, 436, 437, 198/442, 456, 580, 890; 702/223–227
See application file for complete search history.

(56) References Cited

U.S. PATENT DOCUMENTS

| | | | | |
|---|---|---|---|---|
| 3,757,939 | A | 9/1973 | Henig | |
| 3,759,381 | A | 9/1973 | Mercadie et al. | |
| 4,014,784 | A | 3/1977 | Dunlap | |
| 4,140,627 | A | 2/1979 | Weller et al. | |
| 4,388,994 | A | 6/1983 | Suda et al. | |
| 4,554,873 | A | 11/1985 | Rex | |
| 4,627,540 | A | 12/1986 | Takeda | |
| 4,963,251 | A | 10/1990 | Bohm et al. | |
| 4,964,982 | A | 10/1990 | Goldkuhle et al. | |
| 4,997,337 | A | 3/1991 | Trimble | |
| 5,009,321 | A | 4/1991 | Keough | |
| 5,293,983 | A | 3/1994 | Grapes et al. | |
| 5,460,273 | A | 10/1995 | Stevens et al. | |
| 5,542,547 | A | 8/1996 | Ricciardi | |
| 5,634,562 | A | 6/1997 | Isaacs | |
| 5,651,445 | A | 7/1997 | Stevens et al. | |
| 5,755,336 | A | 5/1998 | Rudy | |
| 5,810,174 | A * | 9/1998 | Hamada et al. | 209/584 |
| 5,893,464 | A | 4/1999 | Kiani et al. | |
| 5,901,855 | A * | 5/1999 | Uno et al. | 209/584 |
| 5,960,963 | A | 10/1999 | Chodack et al. | |

(Continued)

*Primary Examiner*—Patrick Mackey
*Assistant Examiner*—Kalyanavenkateshware Kum
(74) *Attorney, Agent, or Firm*—Michael Best Friedrich LLP

(57) ABSTRACT

A new and improved mail sorting system, which is able to dramatically increase the throughput sorting volume of mail pieces or articles, comprises the incorporation of a plurality of cross-circulation path (CCP) conveyors within a conventional looped or folded conveyor belt system whereby, in effect, mail pieces or articles can be effectively removed from primary conveyor flow path sections so as to create gaps or spaces upon the primary conveyor flow path sections into which additional mail pieces or articles can be introduced through means of a second input or infeed port. In addition, a plurality of the new and improved mail sorting systems can be integrated together into a multi-system mail sorting system wherein off-shoot or auxiliary outfeed conveyor belt sections can feed pieces or articles of mail from any particular one of the mail sorting systems to the second input or infeed ports of the other mail sorting systems so as to render the overall system still more efficient.

21 Claims, 4 Drawing Sheets

U.S. PATENT DOCUMENTS

| | | | | |
|---|---|---|---|---|
| 5,994,657 | A | 11/1999 | Maier et al. | |
| 6,609,607 | B2 * | 8/2003 | Woltjer et al. | 198/457.03 |
| 6,644,458 | B1 * | 11/2003 | Edslev-Christensen | 198/370.01 |
| 7,185,888 | B2 * | 3/2007 | Duff et al. | 271/303 |
| 2007/0084764 | A1 * | 4/2007 | Benninger | 209/584 |
| 2007/0090028 | A1 * | 4/2007 | Varney | 209/584 |

* cited by examiner

CROSS CIRCULATION MAIL SORTER STACKER DESIGN WITH DUAL PORTED INPUT, AND METHOD OF OPERATING THE SAME

FIELD OF THE INVENTION

The present invention relates generally to mail sorting systems, and more particularly to a new and improved mail sorting system, and a method of operating the same, which will more efficiently process incoming conveyed mail so as to properly sort the same and deliver such sorted mail to storage bins arranged along a primary conveyor path.

BACKGROUND OF THE INVENTION

Considered from a structural or architectural point of view, high-speed, high-volume, mail sorting systems conventionally comprise two primary sections. A first section, which may be designated as the transportation section, conventionally comprises an input hopper and a singulation mechanism which causes individual envelopes to be inducted onto a continuous transportation pathway. Various devices or mechanisms, such as, for example, multi-line optical character readers (OCRs), that scan, read, and interpret printed or written addresses, or alternatively, bar code readers (BCRs), that scan, read, and interpret previously applied bar code indicia which are representative of a delivery point zip code or postal code, are conventionally disposed or positioned along the transportation pathway so as to determine how the individual mail pieces are to be sorted, that is, the various readers will identify the number of a particular storage bin into which all mail pieces, that are to be delivered to the same next stage of the delivery pathway, such as, for example, a particular destination post office, will be deposited. Such a storage bin determination will of course be made in connection with each mail piece prior to the particular mail piece reaching the termination point or exit of the transportation pathway.

The second section of the mail sorting system, which may be designated the stacker section, comprises the plurality of storage bins which respectively represent the plurality of next stage sorting points. The stacker section receives the singulated, continuous flow of mail pieces from the first transportation section, and will convey the mail pieces to a particular one of its storage bins by means of its conveyor mechanism and a plurality of diverter mechanisms which are disposed along the conveyor path and are respectively operatively associated with each one of the storage bins. More particularly, as a result of electronically associating or correlating each scanned mail piece with a particularly numbered destination storage bin, which represents, in effect, a desired mail piece sorting destination which, in turn, is part of an overall, preexisting logistical plan or path of addressing information by means of which, or along which, the sorted mail pieces can be routed to their final or ultimate destinations, the stacker section will deposit each incoming mail piece into the particularly identified storage bin. The plurality of storage bins of the stacker section are arranged contiguously along the length of the stacker section conveyor mechanism, and each storage bin has an electro-mechanical diverter mechanism operatively associated therewith. Each diverter mechanism is adapted to extract a particular mail piece from the stacker section conveyor mechanism or pathway and divert the same into the particular storage bin with which the diverted mechanism is operatively associated. Appropriate, timer-controlled activation of the particular diverted mechanism therefore causes a particular mail piece intended or destined for that particular storage bin to be physically diverted from the conveyor mechanism or pathway so as to be stacked within the particular storage bin.

A typical conventional PRIOR ART mail sorting system is schematically illustrated within FIG. 1 and is generally indicated by the reference character 10. As can be seen from FIG. 1, the conventional PRIOR ART mail sorting system 10 is seen to comprise a first transportation section 12 from which singulated mail is conveyed downstream into a second stacker section 13 by means of a primary conveyor mechanism 14. It is to be noted in conjunction with such PRIOR ART system 10 that the transportation section 12 is only minimally or generally illustrated, while the stacker section 13 is illustrated in greater detail, in view of the fact that the present invention is concerned with, or directed toward, a new and improved stacker section that departs significantly from the PRIOR ART stacker section 13 as will become more readily apparent hereinafter. It is noted still further that PRIOR ART stacker sections may comprise various different embodiments, or minor design variations, such as, for example, having storage bins disposed upon one or both sides of the conveyor mechanism, multiple levels of storage bins, and many variations directed toward the design details or operational properties of the diverter mechanisms, or toward the geometrical structures or configurations of the storage bins per se. The particular PRIOR ART stacker section 13 illustrated within FIG. 1 has been selected so as to clearly demonstrate both the similarities and significant differences which exist between such PRIOR ART stacker section 13 and the stacker section of the new and improved present invention, as will also become more apparent hereinafter.

More particularly, it is seen that the primary conveyor mechanism 14 comprises a suitable conveyor belt system and is illustrated as being of the "folded" type comprising, in effect, the routing of the conveyor belt system 14 along a flow path which effectively reverses itself 180°. A plurality of mail storage bins 16, comprising the stacker section 13, are disposed along the flow path of the conveyor belt system 14, and it is seen that the mail storage bins 16 are schematically illustrated as being arranged within four storage bin sections, with each storage bin section comprising six storage bins 16, and that the storage bins 16 have also been designated as Bins 1-24. It is of course to be noted that while the conveyor belt system 14 may be of the linear type, as opposed to being of the "folded" type, the present patent application is particularly concerned with a "folded" type conveyor belt system. In addition, it is noted that while the storage bins 16 are disclosed as being arranged within four storage bin sections, with each storage bin section comprising six storage bins 16, for a total number of twenty-four storage bins 16, the particular arrangement of the storage bins 16 is not necessarily limited to the illustrated arrangement, nor is the number of storage bins 16 necessarily limited to twenty-four.

It is noted still further that all of the storage bins 16 are disposed upon the left side of the conveyor belt system 14, as considered in the downstream flow direction of the conveyor belt system 14, as schematically indicated by means of the arrowheads upon the conveyor belt system 14, and a mail piece, solenoid-controlled diverter mechanism 18 is operatively associated with each one of the mail storage bins 16. In this manner, a particular mail piece diverter 18 can divert a particular piece of mail from the conveyor belt system 14 into a particular one of the storage bins 16 when the particular mail piece diverter 18 is actuated in response to receiving a command signal from, for example, a central processing unit (CPU) or programmable logic controller (PLC) 20 which designates the particular storage bin number in response to scanned-address information conveyed to the central processing unit (CPU) 20 by means of the reader mechanisms 21 incorporated within the transportation section 12. Accordingly, it can be appreciated that a predetermined volume of mail can be processed by means of the typical conventional PRIOR ART mail sorting system 10 within a predetermined period of time depending upon the predetermined spacing defined between individual mail pieces disposed upon the conveyor belt system 14, as well as upon the conveyance speed of the conveyor belt system 14.

While the aforenoted conventional PRIOR ART mail sorting system 10 has been operationally satisfactory and commercially successful, it has been realized that the operational efficiency of a system such as that comprising the conventional PRIOR ART mail sorting system 10 is not particularly high, is certainly not as high as is desirable, and is certainly not as high as the operational efficiency of a similar mail sorting system could be. More particularly, it has been realized that when mail pieces are serially conveyed in the downstream direction by means of the conveyor belt system 14 and toward the storage bins 16 for deposition within particular or predetermined ones of the storage bins 16 as predetermined by means of the reader mechanisms 21 of the transportation section 12, the central processing unit (CPU) or programmable logic controller (PLC) 20, and particular ones of the diverter mechanisms 18, if one was to consider the entire incoming batch of mail pieces in a purely random manner, then approximately the same volume of mail would be deposited within each one of the storage Bins 1-24. Accordingly, when the mail pieces are being conveyed by means of conveyor belt system 14 toward the various storage Bins 1-24, approximately one-half of the mail pieces that were originally present upon the conveyor belt system 14 at an initial START position upstream of storage Bin 1 would have been deposited within storage Bins 1-12 by the time that portion of the conveyor belt system 14, originally disposed at the START position immediately upstream of storage Bin 1, reaches the turnaround section 22 of the conveyor belt system 14 just upstream of storage Bin 13. Therefore, only approximately one-half or fifty percent (50%) of the total conveyance space, which is available upon the conveyor belt system 14 for transporting the mail pieces to their storage bin destinations, is at this point in time occupied or actually being used for mail transportation or conveyance purposes. Furthermore, as the remaining mail pieces get delivered to successive ones of the storage Bins 13-24, the percentage of the conveyor belt system 14, which is occupied or actually being used for mail transportation or conveyance purposes, as compared to the total conveyance space which is available upon the entire conveyor belt system 14 for transporting the mail pieces to their storage bin destinations, becomes progressively less. It can therefore be readily appreciated that the spatial utilization efficiency of such a conveyor belt system 14, in connection with the conveyance or transportation of the mail pieces along the entire conveyor belt system flow path extending from Bin 1 to Bin 24, is relatively low.

It has accordingly been proposed that, in order to allegedly or supposedly enhance the operational efficiency or throughput volume of such conventional PRIOR ART systems, either the operational speed of the system be increased, or alternatively, the spatial distance defined between successive mail pieces, as the mail pieces are deposited onto the conveyor belt system 14, be reduced, thereby allegedly or supposedly increasing the spatial utilization efficiency or percentage, or in other words, the amount or percentage of conveyor belt space actually occupied by, and being used to convey, mail pieces. It has been further determined however that neither one of these proposals is truly viable. A reduction in the spacing defined between successive mail pieces poses an operational problem in view of the fact that predetermined gap or spatial minimums must be adhered to in order to viably achieve the downstream gating or diversion of particular mail pieces into their predetermined storage bins 16. A substantial increase in conveyor belt speed likewise poses an operational problem for effectively or properly arresting the movement of each mail piece during its deposition or insertion into a particular one of the storage bins 16. It has also been proposed to simply increase the number of storage bins 16 along the conveyor belt system 14, however, this proposal does not positively or effectively address or increase the spatial utilization efficiency of the system 10, and furthermore, the employment of additional storage bins simply increases the cost of the overall system 10 with little gain in operational efficiency.

A need therefore exists in the art for a new and improved mail sorting system, and a method of operating the same, which will in fact be able to achieve enhanced spatial utilization efficiency and greater mail piece throughput volume without requiring an increase in the operational speed of the conveyor belt system, without having to reduce the spatial distance, defined between successive mail pieces, below viably workable minimums in connection with the desired or required diversion or gating of the mail pieces into their desired storage bins, and without increasing the number of storage bins utilized within the overall mail sorting system so as not to unnecessarily inflate the construction cost of the mail sorting system without improving the performance and efficiency of the system.

OBJECTS OF THE INVENTION

Accordingly, it is an object of the present invention to provide a new and improved mail sorting system and a method of operating the same.

Another object of the present invention is to provide a new and improved mail sorting system, and a method of operating the same, which effectively overcomes the various drawbacks and disadvantages characteristic of conventional PRIOR ART mail sorting systems.

An additional object of the present invention is to provide a new and improved mail sorting system, and a method of operating the same, which dramatically or significantly increases the spatial utilization efficiency of the system in connection with sorted mail and the proper routing of the same toward designated storage bins.

A further object of the present invention is to provide a new and improved mail sorting system, and a method of operating the same, which dramatically or significantly increases the spatial utilization efficiency of the system and therefore greater throughput processing volume of the system.

A last object of the present invention is to provide a new and improved mail sorting system, and a method of operating the same, which dramatically or significantly increases the spatial utilization efficiency of the system and therefore greater throughput processing volume of the system without requiring an increase in the operational speed of the conveyor belt system, without having to reduce the spatial distance, defined between successive mail pieces, below viably workable minimums in connection with the desired or required diversion or gating of the mail pieces into their desired storage bins, and without increasing the number of storage bins utilized within the overall mail sorting system so as not to unnecessarily inflate the construction cost of the mail sorting system without improving the performance and efficiency of the system.

SUMMARY OF THE INVENTION

The foregoing and other objectives are achieved in accordance with the teachings and principles of the present invention through the provision of a new and improved mail sorting system, and a method of operating the same, which comprises a folded or looped conveyor belt system having a plurality of storage bins disposed within a serial array upon one side of the conveyor belt. The folded or looped conveyor belt system flow path comprises, for example, two longitudinally extending, parallel flow path sections spaced a predetermined distance apart wherein a first one of the longitudinally extending flow path sections may be considered an upstream flow path section while the second one of the longitudinally extending flow path sections may be considered a downstream flow path section, and wherein the mail pieces are inserted or deposited onto the conveyor belt system at a first entry or infeed port located at the upstream end of the first upstream flow path section.

End or turn-around flow path sections integrally interconnects the downstream ends of the first upstream and second downstream flow path sections to the upstream ends of the first and second flow path sections, and in accordance with the unique and novel structure comprising the present invention, a plurality of cross-circulation paths (CCPs), including cross-circulation paths (CCPs) integrally incorporated within the end or turn-around flow path sections, extend across the space defined between the pair of longitudinally extending flow path sections so as to effectively short-circuit the flow path along which a mail piece would normally be conveyed. Furthermore, the plurality of cross-circulation paths (CCPs) can effectively be coupled together so as to form a plurality of cross-circulation rings (CCRs) which not only extend from the first longitudinal upstream flow path section, across the space or divide separating the two longitudinally extending, parallel flow path sections, and operatively connect to the second longitudinal downstream flow path section, but also, conversely, extend from the second longitudinal downstream flow path section, across the space or divide separating the two longitudinally extending, parallel flow path sections, and operatively connect to the first longitudinal upstream flow path section. These cross-circulation paths (CCPs) and cross-circulation rings (CCRs) not only enable particular mail pieces to effectively bypass intermediate storage bins located between the initial entry point of the mail pieces onto the conveyor belt system and their predetermined storage bin destinations, but more importantly, enable the mail pieces to effectively be removed from the conveyor belt system, particularly within the vicinity of the end or turn-around flow path sections, so as to define vacant spaces into which additional, new mail pieces can be inserted or deposited onto the conveyor belt system by means of a second entry or infeed port located at the upstream end of the second downstream flow path section. As a result of such integrated structure, the flow-through output volume of the new and improved mail sorting system is approximately twice that of a conventional PRIOR ART mail sorting system.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
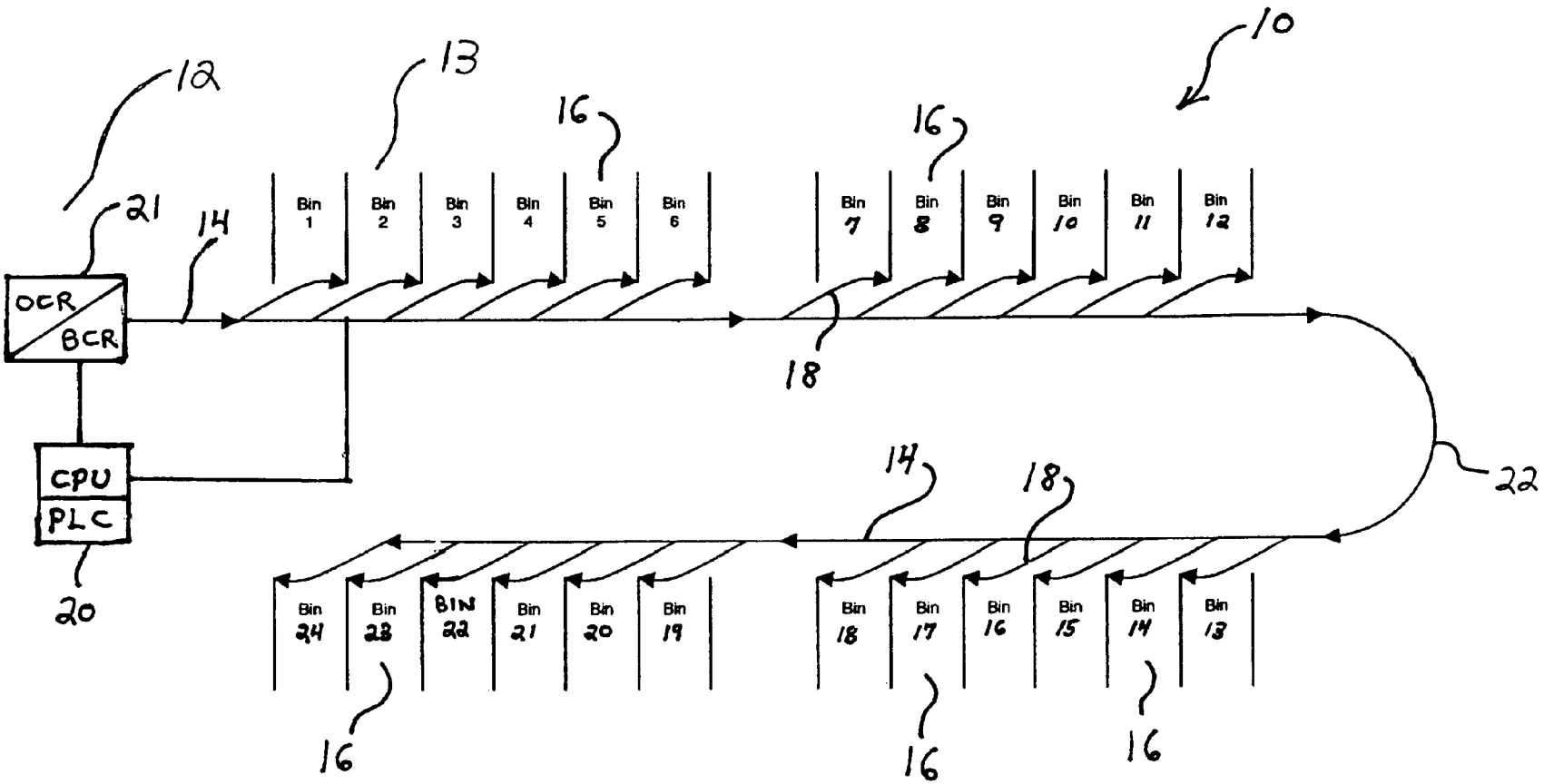
FIGURE 1 (PRIOR ART)
FIG. 1 is a schematic diagram showing a conventional PRIOR ART mail sorting system showing the integrated cooperative parts thereof.
Figure 2:
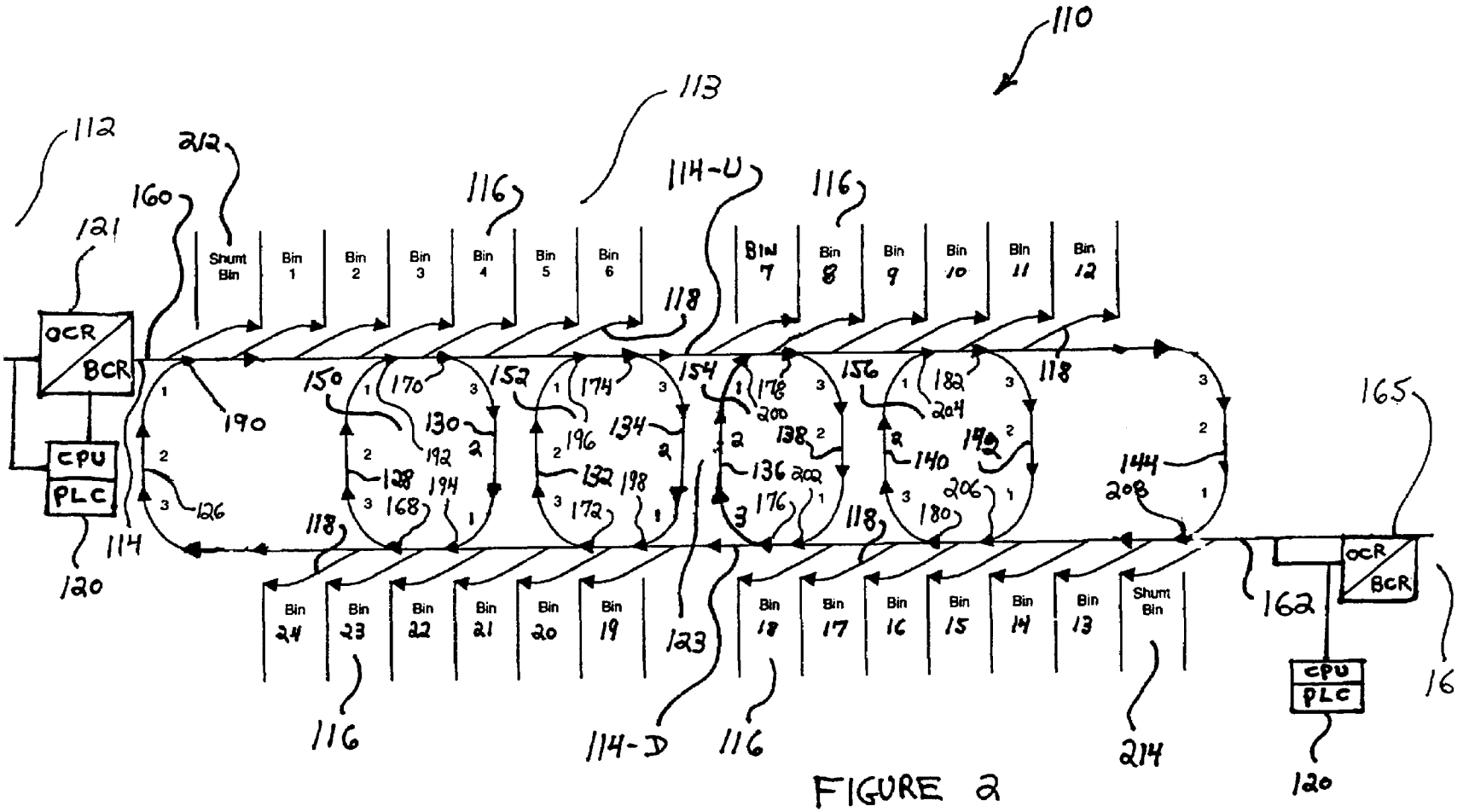
FIG. 2 is a schematic diagram similar to that of FIG. 1 showing, however, a first embodiment of a new and improved mail sorting system constructed in accordance with the principles and teachings of the present invention and showing the integrated cooperative parts thereof.

Referring now to the drawings, and more particularly to FIG. 2 thereof, a first embodiment of a new and improved mail sorting system, constructed in accordance with the principles and teachings of the present invention, is disclosed and is generally indicated by the reference character 110. It is initially noted that the new and improved mail sorting system 110 as disclosed within FIG. 2 is similar to the conventional PRIOR ART mail sorting system 10 as disclosed within FIG. 1, and therefore, with respect to those structural or operative components of the new and improved mail sorting system 110 which are similar or correspond to those structural or operative components of the conventional PRIOR ART system 10, such structural or operative components will be designated by similar reference characters except that they will be within the 100 series. More particularly, it is seen that the new and improved mail sorting system 110 comprises an upstream mail transportation section 112 from which singulated sorted mail is conveyed downstream toward and into a stacker section 113 by means of a primary conveyor belt system 114. As was the case with the conventional PRIOR ART conveyor belt system 14, the primary conveyor belt system 114 is of the "folded" type comprising the routing of the conveyor belt system 114 along a flow path which effectively reverses itself 180°, and a plurality of mail storage bins 116, comprising the stacker section 113, are disposed along the flow path of the conveyor belt system 114. For enhanced clarity and ease of understanding, it will be noted that the conveyor belt system 114 will be considered to be divided into an upstream conveyor belt system section 114-U and a downstream conveyor belt system section 114-D separated or spaced apart by means of an intermediate space 123.

The plurality of mail storage bins 116 are schematically illustrated as being arranged within four storage bin sections with each storage bin section comprising six storage bins 116, and the storage bins 116 have also been designated as Bins 1-24. In addition, it is noted that while the storage bins 116 are disclosed as being arranged within four storage bin sections, with each storage bin section comprising six storage bins 116, except as will be noted hereinafter, for a total number of twenty-four storage bins 116, the particular arrangement of the storage bins 116 is not necessarily limited to the illustrated arrangement, nor is the number of storage bins 116 necessarily limited to twenty-four. It is noted still further that all of the storage bins 116 are disposed upon the left side of the conveyor belt system 114, as considered in the downstream flow direction of the conveyor belt system 114 as schematically indicated by means of the arrowheads upon the conveyor belt system 114, and a mail piece, solenoid-controlled diverter mechanism 118 is operatively associated with each one of the mail storage bins 116. In this manner, a particular mail piece diverter mechanism 118 can divert a particular piece of mail from the conveyor belt system 114 into a particular one of the storage bins 116 when the particular mail piece diverter mechanism 118 is actuated in response to receiving a command signal from, for example, a central processing unit (CPU) or programmable logic controller (PLC) 120 which designates the particular storage bin number in response to scanned address information conveyed to the central processing unit (CPU) or programmable logic controller (PLC) 120 by means of the reader mechanisms 121 incorporated within the transportation section 112. It is to be noted that while the diverter mechanisms 118 have been described as comprising, for example, solenoid-actuated or solenoid-controlled mechanisms, other types of diverter mechanisms may of course be utilized.

While the aforenoted structure defining or comprising the first embodiment of the new and improved mail sorting system 110 as illustrated within FIG. 2 is obviously similar to the aforenoted structure defining or comprising the conventional PRIOR ART mail sorting system 10 as illustrated within FIG. 1, the following additional structure further defining or comprising the first embodiment of the new and improved mail sorting system 110, as developed in accordance with the principles and teachings of the present invention, renders the new and improved mail sorting system 110 of the present invention quite unique, novel, and dissimilar from the structure defining or comprising the conventional PRIOR ART mail sorting system 10. More particularly, as can be readily appreciated as a result of reference continuing to be made to FIG. 2, the unique and novel structure of the present invention, which operatively supplements the aforenoted structure comprising the basic conventional or PRIOR ART mail sorting system 10, or the corresponding aforenoted structure comprising the mail sorting system 110, comprises a plurality of cross-circulation path (CCP) conveyors 126,128,130,132,134,136,138,140,142,144, which are disposed within the open space 123 separating the upstream and downstream conveyor belt system sections 114-U and 114-D and which operatively interconnect the upstream and downstream conveyor belt system sections 114-U and 114-D. Together, it is also seen that each pair of cross-circulation path (CCP) conveyors 128-130,132-134,136-138,140-142, form four cross-circulation ring (CCR) conveyors 150, 152, 154, 156, between the upstream and downstream conveyor belt system sections 114-U and 114-D, although, as was the case with the number of storage Bins 1-24, the particular number of cross-circulation path (CCP) conveyors, and the number of cross-circulation ring (CCR) conveyors may vary. As can lastly be seen from FIG. 2, conveyance of the mail pieces along each one of the cross-circulation path (CCP) conveyors 126-144 and within each one of the cross-circulation ring (CCR) conveyors 150-156 is in the clockwise direction.

As will be readily appreciated as a result of reference being made to FIG. 2, one of the purposes or advantages to be derived from the new and improved mail sorting system 110, and in particular, from the overall conveyor system structure comprising the conveyor belt system 114, the cross-circulation path (CCP) conveyors 126-144, and the cross-circulation ring (CCR) conveyors 150-156, is that a plurality of short-circuit flow paths are effectively defined between the upstream and downstream conveyor belt system sections 114-U and 114-D by means of the cross-circulation path (CCP) conveyors 126-144 and the cross-circulation ring (CCR) conveyors 150-156. More particularly, for example, when a particular mail piece is conveyed by means of the conveyor belt system 114 so as to be initially disposed at a first input port or position 160 upstream of storage Bin 1, and if, for example, the ultimate sorting destination of the mail piece is storage Bin 24, then in lieu of the mail piece being conveyed along the entire flow path route of the conveyor belt system 114 comprising upstream conveyor belt system section 114-U, the end or last cross-circulation path (CCP) conveyor 144, and downstream conveyor belt system section 114-D, the mail piece can alternatively be routed along any one of the short circuit flow paths defined, for example, by means of cross-circulation path (CCP) conveyors 130, 134, 138,142. Even more specifically, if any particular mail piece initially disposed at the first input position 160 has an ultimate storage bin destination which comprises, for example, any one of the storage Bins 13-24 located upon the downstream conveyor belt system section 114-D, then that mail piece can optionally be routed along any one of the cross-circulation path (CCP) conveyors 130,134,138,142,144 depending upon the availability of such cross-circulation path (CCP) conveyors 130,134,138,142,144, as will be explained more fully shortly hereinafter.

Another purpose or advantage to be derived from the new and improved mail sorting system 110, and in particular, from the provision of the plurality of short-circuit flow paths defined by means of the cross-circulation path (CCP) conveyors 130,134,138,142,144 is that as a result of the routing of the mail pieces along any one of the short-circuit flow paths comprising, for example, cross-circulation path (CCP) conveyors 130,134,138,142,144, the mail pieces are effectively removed from the upstream conveyor belt system section 114-U at positions upstream of the end or last cross-circulation path (CCP) conveyor 144 of the conveyor belt system 114 thereby creating spaces or gaps upon the upstream conveyor belt system section 114-U at positions upstream of the end or last cross-circulation path (CCP) conveyor 144 of the conveyor belt system 114.

In turn, the creation of such gaps or spaces upon the upstream conveyor belt system section 114-U at positions upstream of the end or last cross-circulation path (CCP) conveyor 144 of the conveyor belt system 114 enables the conveyor belt system 114 to be provided with additional mail pieces which can be introduced onto the conveyor belt system 114 by means of a second mail piece input port 162 which is effectively located at the downstream end of the end or last cross-circulation path (CCP) conveyor 144 and upstream of the storage Bin 13, wherein the second mail piece input port 162 has operatively associated therewith a second mail piece transportation section 163. The second mail transportation section 163 has suitable bar code reader (BCR) or optical character recognition (OCR) reader apparatus 165 incorporated therein, and such bar code reader (BCR) or optical character recognition (OCR) reader apparatus 165 is likewise operatively connected to the central processing unit (CPU) or programmable logic controller (PLC) 120. In this manner, the spaces or gaps previously created upon the upstream conveyor belt system section 114-U, as a result of the removal of mail pieces from the upstream conveyor belt system section 114-U by routing the mail pieces along the short-circuit flow paths comprising the cross-circulation path (CCP) conveyors 130,134,138,142,144 can effectively be used again by refilling such spaces or gaps with new mail pieces introduced into the conveyor belt system 114 by means of the second mail piece input port 162.

As an additional result or advantage to be derived in conjunction with the provision of the second mail piece input port 162, it can be further appreciated that a second, reverse, or mirror-image, mail piece flow process is also able to be generated within the mail sorting system 110. More particularly, when a particular mail piece is effectively inserted into the conveyor belt system 114 so as to be initially disposed at the second input port or position 162 upstream of storage Bin 13, and if, for example, the ultimate sorting or storage destination of the mail piece is storage Bin 12, then in lieu of the mail piece being conveyed along the entire flow path route of the conveyor belt system 114 comprising downstream conveyor belt system section 114-D, the end or last cross-circulation path (CCP) conveyor 126, and the upstream conveyor belt system section 114-U, the mail piece can alternatively be routed along any one of the short circuit flow paths defined, for example, by means of cross-circulation path (CCP) conveyors 140,136,132, 128, again depending upon the particular availability of such cross-circulation path (CCP) conveyors 140,136,132,128, as will be explained more fully shortly hereinafter. Even more specifically, if any particular mail piece initially inserted at the second input position 162 has an ultimate storage bin destination which comprises, for example, any one of the storage Bins 1-12 located upon the upstream conveyor belt system section 114-U, then that mail piece can optionally be routed along any one of the cross-circulation path (CCP) conveyors 140,136,132,128 depending upon the availability of such cross-circulation path (CCP) conveyors 140,136,132,128, as will be explained more fully shortly hereinafter.

In addition, as was also the case with the mail pieces being introduced into the mail sorting conveyor belt system 114 at the first input port 160, as a result of the routing of the mail pieces along any one of the short-circuit flow paths comprising, for example, cross-circulation path (CCP) conveyors 140,136,132,128, the mail pieces are effectively removed from the downstream conveyor belt system section 114-D prior to or upstream of the end or last cross-circulation path (CCP) conveyor 126, thereby creating spaces or gaps upon the downstream conveyor belt system section 114-D at positions upstream of the end or last cross-circulation path (CCP) conveyor 126. In turn, the removal of the mail pieces from the downstream conveyor belt system section 114-D and the creation of such gaps or spaces upon the downstream conveyor belt system section 114-D at positions upstream of the end or last cross-circulation path (CCP) conveyor 126, enables those gaps or spaces created upon the downstream conveyor belt system section 114-D to be effectively used again by refilling such spaces or gaps with new mail pieces introduced into the conveyor belt system 114 by means of the first mail piece input port 160. In this manner, it can be further appreciated that as a result of the provision of the plurality of cross-circulation path (CCP) conveyors 126-144, the definition of the cross-circulation ring (CCR) conveyors 150-156, the two sets of short-circuit flow path conveyors 130,134,138,142, 144, and 140,136,132, 128,126, and the first and second mail piece input ports 160,162, a dual-ported input conveyor belt system 114 has effectively been created which is capable of handling substantially twice the mail volume throughput as has been heretofore conventionally possible.

With reference still being made to FIG. 2, it will be noted further that each one of the cross-circulation path (CCP) conveyors 126-144 comprises a three-stage cross-circulation path (CCP) conveyor comprising first, second, and third stage conveyors 1,2,3. Disposed upon each one of the upstream and downstream conveyor belt system sections 114-U and 114-D, and disposed immediately upstream of each third stage conveyor 3 of each one of the three-stage cross-circulation path (CCP) conveyors 128-142 comprising each one of the cross-circulation ring (CCR) conveyors 150-156, there is respectively provided a mail piece diverter mechanism 168-182, each one of which is operatively similar to the mail piece diverter mechanism 118 operatively associated with each one of the storage bins 116. In accordance with the control arrangement governing the utilization of the three conveyors 1-3 comprising each three-stage cross-circulation path (CCP) conveyor 126-144, when a particular mail piece is to be diverted from either one of the upstream or downstream conveyor belt system sections 114-U or 114-D onto a particular one of the cross-circulation path (CCP) conveyors 128-142, the respective one of cross-circulation path (CCP) mail piece diverter mechanisms 168-182 which is operatively associated with the particular one of the cross-circulation path (CCP) conveyors 128-142 will be activated.

It is to be noted that a mail piece can only be diverted from either one of the upstream or downstream conveyor belt system sections 114-U or 114-D onto a particular one of the cross-circulation path (CCP) conveyors 128-142 when the third stage conveyor 3 of that particular one of the cross-circulation path (CCP) conveyors 124-146 is available, that is, unoccupied by any other mail piece. Still further, once a particular mail piece has entered a particular one of the cross-circulation path (CCP) conveyors 128-142 as a result of being conveyed onto its respective third stage conveyor 3, it can only be successively advanced to the second and first stage conveyors 2 and 1 if such second and first stage conveyors 2 and 1 are available or unoccupied by other mail pieces. In a similar manner, and ultimately, the particular mail piece can only be advanced further from the first stage conveyor 1 onto either one of the upstream or downstream conveyor belt system sections 114-U or 114-D, in preparation for discharge or conveyance into a particular storage bin 116, if the particular upstream or downstream conveyor belt system section 114-U or 114-D has a space or gap present thereon for receiving the mail piece. It is also to be noted that in accordance with the logical control hierarchy, each mail piece is advanced as far as possible through the three stage conveyors, comprising the third, second, and first stage conveyors 3,2,1, of each one of the cross-circulation path (CCP) conveyors 126-144, that is, if both the third and second stage conveyors 3,2 are empty or available, the mail piece is advanced onto the second stage conveyor 2. If all three stage conveyors 3,2,1 are empty or available, then the mail piece is advanced to the first stage conveyor 1 in preparation for insertion onto or capture by one of the upstream or downstream conveyor belt system sections 114-U, 114-D. Conversely, if a particular one of the stage conveyors 1,2,3 is occupied and therefore not available, the mail piece is held upon the previous stage conveyor, and if all three stage conveyors 1,2,3 of a particular one of the cross-circulation path (CCP) conveyors 128-142 are occupied and not available, then the mail piece is conveyed to the next available cross-circulation path (CCP) conveyor.

It is noted still further that in order to convey the particular mail piece from a particular one of the first stage conveyors 1 onto either one of the upstream or downstream conveyor belt system sections 114-U or 114-D, each one of the first stage conveyors 1 of each one of the cross-circulation path (CCP) conveyors 126-144 comprises a cross-circulation path (CCP) conveyor adaptive merge mechanism 190-208 which is fully integrated into the mail sorting system 110, and in particular with respect to the central processing unit (CPU) or programmable logic controller (PLC) 120, so as to appropriately insert or merge a particular mail piece disposed upon a particular first stage conveyor 1 of a particular one of the cross-circulation path (CCP) conveyors 126-144 with either one of the upstream or downstream conveyor belt system sections 114-U or 114-D. Full structural and operational details of such conveyor merge mechanisms are disclosed within U.S. patent application Ser. No. 09/843,916 which was filed on Apr. 30, 2001 in the name of Jack E. Olson et al., entitled DYNAMIC GAP ESTABLISHING SYNCHRONOUS PRODUCT INSERTION SYSTEM, and is assigned to the assignee of the present patent application. It is therefore to be appreciated that all pieces or articles of mail, their disposition or location within the system 110, and the operation or activation of the various control components, such as, for example, the storage bin diverter mechanisms 118, the operation of the first, second, and third stages 1,2,3 of each multi-stage cross-circulation path (CCP) conveyor 126-144, the cross-circulation path (CCP) diverter mechanisms 168-182, and the conveyor adaptive merge mechanisms 190-208, are constantly monitored and controlled by means of the central processor unit (CPU) or programmable logic controller (PLC) 120.

In operation, incoming mail is of course inputted into the mail sorting system 110 through means of both input or infeed ports 160,162, and as a result of the scanning or reading of the incoming mail pieces or articles by means of the respective bar code reader (BCR) or optical character recognition (OCR) components 121,165 disposed within the transportation sections 112,163, each incoming mail piece or article is identified, and the identification information concerning each piece or article of mail is inputted into the memory of the central processing unit (CPU) or programmable logic controller (PLC) 120. Accordingly, the central processing unit (CPU) or programmable logic controller (PLC) 120 will appropriately control the various operative components of the mail sorting system 110 so as to enable a particular piece or article of mail to reach its intended storage bin destination. More particularly, for example, if a particular piece or article of mail, conveyed along upstream conveyor path 114-U and introduced into the system 110 through means of infeed or input port 160, is identified as having a storage bin address corresponding to that of one of the storage Bins 1-12, that is, one of the storage bins disposed adjacent to the upstream conveyor path 114-U, then that particular piece or article of mail will be conveyed along upstream conveyor path 114-U until it reaches its predetermined storage bin destination whereupon the storage bin diverter mechanism 118, which is operatively associated with that particular destination storage bin, will be activated so as to divert the particular piece or article of mail into that particular storage bin.

On the other hand, if, for example, a particular piece or article of mail, conveyed along the upstream conveyor path 114-U and introduced into the sorting system 110 through means of infeed or input port 160, is identified as having a storage bin address corresponding to that of one of the storage Bins 13-24, that is, one of the storage bins disposed adjacent to the downstream conveyor path 114-D, then that particular piece or article of mail will be conveyed along upstream conveyor path 114-U until it reaches an appropriate and available cross-circulation path (CCP) conveyor 130,134,138,142,144. What is meant by means of an appropriate cross-circulation path (CCP) is one that is positionally located so as to in fact enable the piece or article of mail to be delivered to the specified storage bin. For example, if the article or piece of mail is destined for deposition and storage within storage Bin 16, then cross-circulation path (CCP) conveyors 130,134, and 138 are not appropriate cross-circulation path (CCP) conveyors because their merge points 194,198, and 202 with downstream conveyor path 114-D are located downstream of storage Bin 16. In addition, the piece or article of mail must be conveyed into an available cross-circulation path (CCP) conveyor, that is, one in which space is available upon at least one of the first, second, or third stage conveyor sections 1,2,3 of the particular cross-circulation path (CCP) conveyor. Obviously, what has just been stated in connection with the input or infeed of pieces or articles of mail onto the upstream conveyor path 114-U, through means of the first infeed or input port 160 and with respect to the particular storage bin destinations therefrom, likewise holds true for the introduction of pieces or articles of mail onto the downstream conveyor path 114-D through means of the second infeed or input port 162 and with respect to the particular storage bin destinations therefrom.

It is to be noted further that in connection with the introduction of the articles or pieces of mail through the first and second input or infeed ports 160,162, as well as in connection with the conveyance and routing of the articles or pieces of mail along either one of the upstream and downstream conveyor paths 114-U, 114-D, and furthermore in connection with the disposition or location of the articles or pieces of mail located temporarily within the various cross-circulation path (CCP) conveyors 126-144 wherein such mail is awaiting further conveyance or routing along the upstream and downstream conveyor paths 114-U, 114-D and into a particular one of the storage Bins 1-24, circumstances may potentially occur or coalesce whereby means need to be provided in order to accommodate, in effect, an overload condition of incoming mail pieces or articles upon one or both of the upstream and downstream conveyor paths 114-U, 114-D so as to effectively prevent the operational jamming of the mail sorting system 110. For example, conveying circumstances may be such that the upstream conveyor path 114-U may be substantially filled in that substantially no spaces or gaps currently exist upon the upstream conveyor path 114-U because all pieces or articles of mail disposed thereon are awaiting disposition or diversion into storage Bins 1-12. In addition, all of the cross-circulation path (CCP) conveyors 126,128,132,136, and 140 may likewise be filled with pieces or articles of mail awaiting diversion onto the upstream conveyor path 114-U. Still further, additional mail pieces or articles are being conveyed onto or along the upstream conveyor path 114-U through means of the first infeed or input port 160, and similar conveyance and positional situations may likewise exist with respect to the downstream conveyor path 114-D and its associated cross-circulation path (CCP) conveyors 130,134,138,142,144 leading onto the same.

Accordingly, in order to temporarily relieve such overcrowding or overload conveyance situation, each one of the upstream and downstream conveyor paths 114-U, 114-D is respectively provided with a Shunt Bin 212,214 at a position along each conveyor path 114-U, 114-D so as to be respectively located immediately upstream of storage Bins 1 and 13. As a result of the provision of such Shunt Bins 212, 214, when such aforenoted overload or overcrowded conditions are sensed or detected, particularly considering the disposition of mail pieces upon all three of the first, second, and third stage conveyors 1,2,3 of the cross-circulation path (CCP) conveyors 126 and 144, then the diverter mechanisms 118 operatively associated with the respective Shunt Bins 212 or 214 will be activated such that any mail pieces or articles, being conveyed along the upstream and downstream conveyor paths 114-U and 114-D, at positions upstream of the Shunt Bins 212,214, can be diverted into the respective Shunt Bin 212 or 214 from which they can be manually retrieved at a later point in time. Since all conveyed pieces or articles of mail have been originally identified and are continuously monitored by means of the system 110, that is, through means of the bar code reader (BCR) or optical character recognition (OCR) components 121,165 disposed within the transportation sections 112,163 and the central processing unit (CPU) or programmable logic controller (PLC) 120, the system will readily be aware of which pieces or articles of mail have been diverted into the Shunt Bins 212,214, and when such pieces or articles of mail are retrieved from the Shunt Bins 212,214, they can be re-inserted into the conveyor system 114 and again be re-read or re-detected by means of the bar code reader (BCR) or optical character recognition (OCR) components 121,165 disposed within the transportation sections 112,163 so that the central processing unit (CPU) or programmable logic controller (PLC) 120 again knows precisely where such mail pieces or articles are located.

It is noted still further that in conjunction with the activation of the Shunt Bins 212,214, the infeed conveyors of the transportation sections 112,163 may also be temporarily stopped or paused such that no new mail pieces can be conveyed toward the upstream and downstream conveyor paths 114-U, 114-D, the critically important operations being the effective creation of spaces or gaps upon the upstream and downstream conveyor paths 114-U, 114-D so as to permit the mail pieces to be fed outwardly from the end cross-circulation path (CCP) conveyors 126,144 so as to effectively and positively prevent any jamming or blockage of the system. It is also noted that sometimes the simultaneous or concurrent stoppage or pausing of the infeed conveyors of the transportation sections 112,163, in conjunction with the actuation of the diverter mechanisms 118 operatively associated with the Shunt Bins 212,214, may not be necessary because the diverter mechanisms 118 operatively associated with the Shunt Bins 212,214 may be actuated so as to, for example, discharge a rejected mail piece from one or both of the upstream and downstream conveyor paths 114-U, 114-D. A particular mail piece may be rejected due to, for example, an erroneous or unintelligible reading of its routing or addressing information by means of the bar code reader (BCR) or optical character recognition (OCR) components 121,165 disposed within the transportation sections 112,163.

Since the particular mail piece has not been properly read, its destination cannot be accurately known, and therefore, it cannot be delivered to its proper storage bin. Accordingly, it will be rejected and discarded into one of the Shunt Bins 212,214. This of course causes a space or gap to be created upon the particular one of the upstream and downstream conveyor paths 114-U, 114-D so as to permit, for example, a mail piece, disposed upon the first stage conveyor 1 of either one of the cross-circulation path (CCP) conveyors 126,144, to be conveyed onto the respective one of the upstream and downstream conveyor paths 114-U, 114-D. It is to be recognized still further that various operative interactions of the various system components, that is, the opening of the shunt bins and the stoppage or pausing of the infeed conveyors of the transportation sections 112,163, may be suitably performed and controlled, under the auspices of the central processing unit (CPU) or programmable logic controller (PLC) 120. It is lastly noted in conjunction with the routing of the particular mail pieces along the various cross-circulation path (CCP) conveyors 126-144, as well as along the upstream and downstream conveyor paths 114-U, 114-D, that if, for example, it is determined, by means of, for example, the central processing unit (CPU) or programmable logic controller (PLC) 120, that a particular mail piece, disposed upon the first stage conveyor 1 of one of the various cross-circulation path (CCP) conveyors 126-144, has the same storage bin destination as another mail piece being conveyed along one of the upstream and downstream conveyor paths 114-U, 114-D, then the central processing unit (CPU) or programmable logic controller (PLC) 120 may actuate the appropriate one of the cross-circulation path (CCP) conveyor adaptive merge mechanisms 190-208 such that the two mail pieces may, in effect, be piggy-backed together for simultaneous conveyance toward, and deposition into, a particular one of the storage Bins 1-24.

Figure 3:
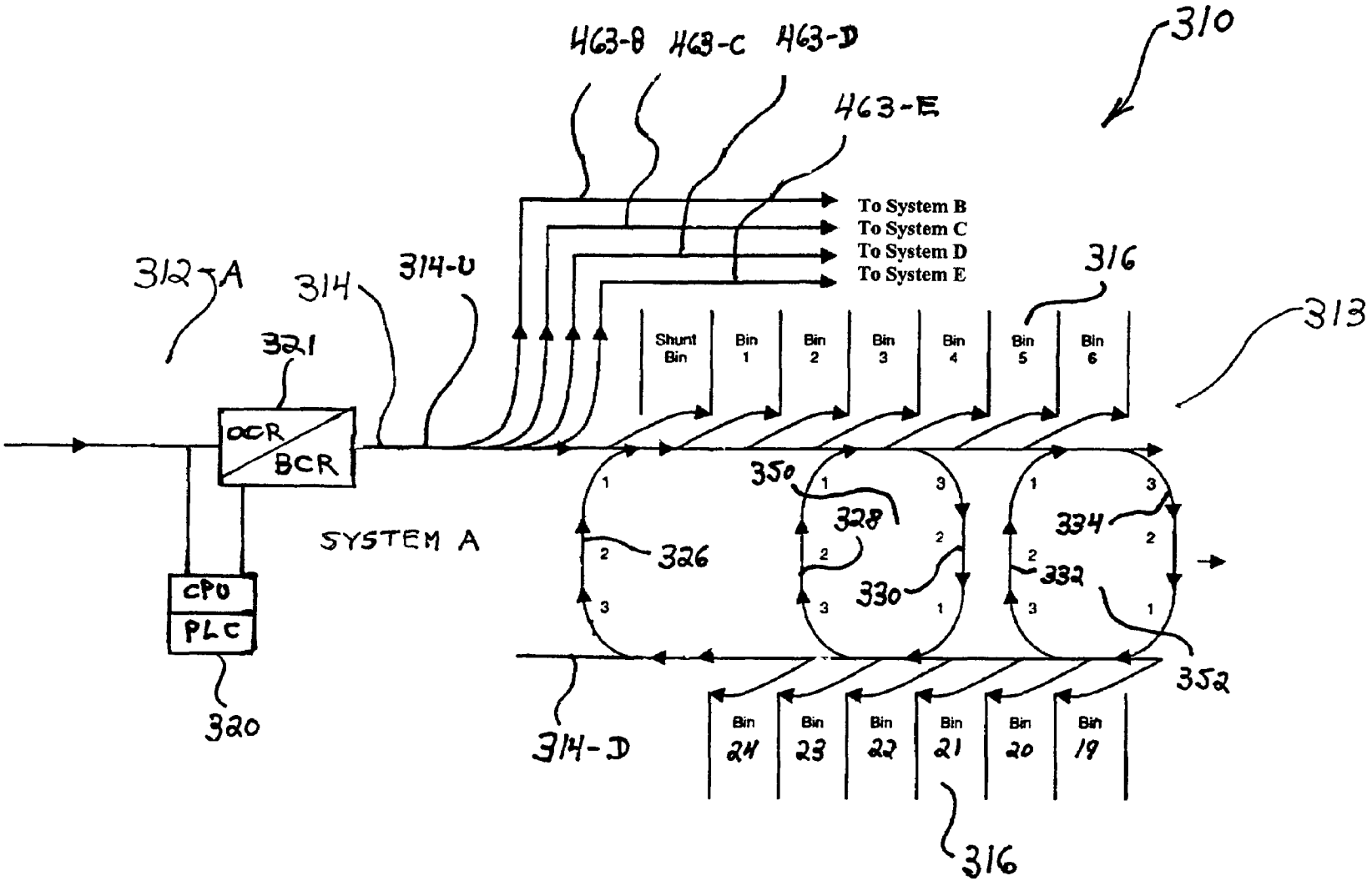
FIG. 3 is a schematic diagram similar to that of FIG. 2 showing, however, a second, modified embodiment of a new and improved mail sorting system, constructed in accordance with the principles and teachings of the present invention and showing the integrated cooperative parts thereof, wherein the basic system disclosed within FIG. 2 can be utilized in conjunction with a plurality of other systems, each of which is similar to that of FIG. 2, so as to effectively form a multi-system arrangement wherein mail pieces can be fed out of the basic system along a plurality of outfeed flow paths and such outfeed flow paths can serve as one of the infeed flow paths or inputs into each one of the other systems.

With reference now being made to FIG. 3, a second modified embodiment of a new and improved mail sorting system, constructed in accordance with the principles and teachings of the present invention, is disclosed and is generally indicated by the reference character 310. It is initially noted that the second embodiment of the new and improved mail sorting system 310 as disclosed within FIG. 3 is similar to the first embodiment of the new and improved mail sorting system 110 as disclosed within FIG. 2, except as modified, as will be subsequently noted, and therefore, with respect to those structural or operative components of the new and improved mail sorting system 310 which are similar or correspond to those structural or operative components of the new and improved mail sorting system 110, such structural or operative components will be designated by similar reference characters except that they will be within the 300 and 400 series. It is additionally noted that only a part of the overall mail sorting system 310 is disclosed within FIG. 3, as can readily be appreciated from a comparison of the disclosed portion of the mail sorting system 310 as disclosed within FIG. 3, with the mail sorting system 110 as disclosed within FIG. 2, and the reason for the partial disclosure of the mail sorting system 310 is that the significantly different or novel features, which are uniquely characteristic of the mail sorting system 310, are present within the disclosed portion of the mail sorting system 310.

More particularly, for the purposes of this modified second embodiment of the mail sorting system 310, the mail sorting system 310 may be considered to comprise a mail transportation section 312-A for infeeding pieces of mail onto a conveyor belt system 314 of what is, in effect, a first system A. In addition, at a position which is located upon the upstream conveyor belt system section 314-U, and which is disposed immediately upstream of the first cross-circulation path (CCP) 326, a plurality of auxiliary off-shoot or outfeed conveyor paths, which will effectively comprise parts of transportation sections which will be similar to mail transportation section 163 as disclosed within FIG. 2, are disclosed at 463-B,463-C,463-D,463-E. The transportation sections 463-B, 463-C,463-D,463-E lead to, and are adapted to be respectively operationally connected with, a plurality of mail sorting systems B,C,D,E, each one of which is substantially identical to the mail sorting system A. In particular, each one of the off-shoot conveyor paths 463-B, 463-C,463-D,463-E can therefore effectively serve as an in-feed to one of the second input or infeed ports, similar to the second input or infeed port 162 of the mail sorting system 110, for each one of the mail sorting systems B,C,D,E. It is of course to be noted that to the degree that mail pieces may be directed to any one or all of the plurality of auxiliary off-shoot or outfeed transportation sections 463-B,463-C,463-D,463-E, input or infeed loading of the stacker section 313 is accordingly reduced.

Figure 4:
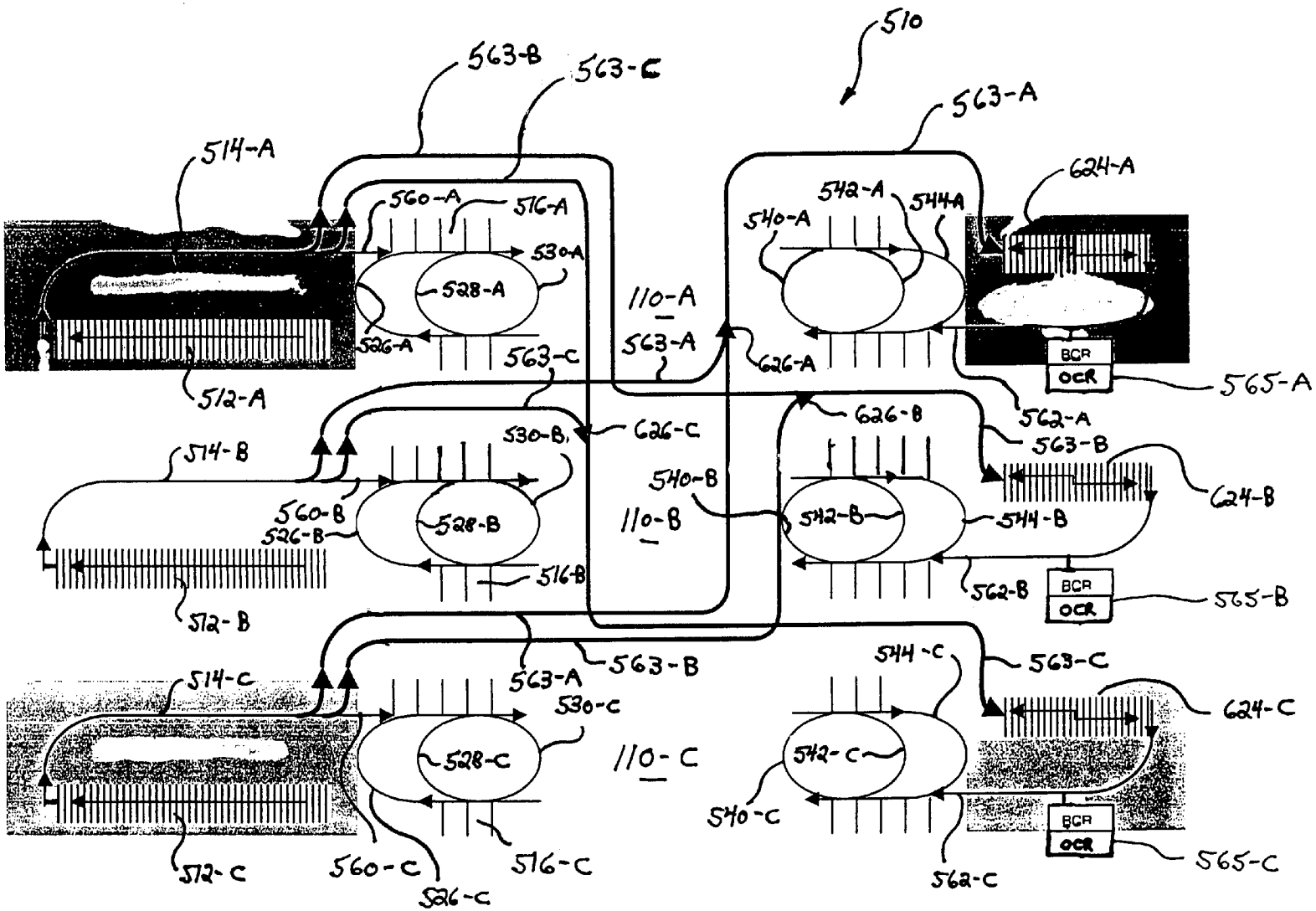
FIG. 4 is a schematic diagram similar to that of FIG. 3 showing, however, a third modified embodiment of a new and improved mail sorting system, constructed in accordance with the principles and teachings of the present invention and showing the integrated cooperative parts thereof, wherein the detailed integration of three mail sorting systems, each one of which is similar to that disclosed within FIG. 2, in accordance with the integration arrangement schematically illustrated within FIG. 3 comprises two outfeed flow paths of mail pieces from any one of the three mail sorting systems serves as a second infeed flow path or input into each one of the other two mail sorting systems.

With reference lastly being made to FIG. 4, there is disclosed a third modified embodiment of a new and improved mail sorting system which is constructed in accordance with the principles and teachings of the present invention and which is generally indicated by the reference character 510. It is initially noted that the third embodiment of the new and improved mail sorting system 510 as disclosed within FIG. 4 is similar to the first and second embodiments of the new and improved mail sorting systems 110, 310 as respectively disclosed within FIGS. 2 and 3, except as modified, as will be subsequently noted, and therefore, with respect to those structural or operative components of the new and improved mail sorting systems 510 which are similar or correspond to those structural or operative components of the new and improved mail sorting systems 110,310, such operative or structural components will be designated by similar reference characters except that they will be within the 500 and 600 series.

More particularly, the mail sorting system 510 comprises an integrated multi-system mail sorting system comprising the operative integration of three mail sort-ing systems each one of which is similar to the mail sorting system 110 disclosed within FIG. 2. Conceptually, it is to be appreciated that the integrated, multi-system mail sorting system 510, as disclosed within FIG. 4, effectively creates a single, massive, mail sorting system, comprising three primary input feeders, wherein each one of the three primary input feeders, of any one sorting system, is operatively connected to each one of the other sorting systems such that all of the storage bins of any one sorting system are available to all of the mail pieces that are being inputted into the integrated, multi-system mail sorting system 510 regardless or irrespective of which one of the three primary input feeders the particular mail piece was originally inputted into. Accordingly, assuming that each one of the three sorting systems, integrated in the foregoing manner wherein the details of such integration will be disclosed shortly hereinafter, has a predetermined number of storage bins, which corresponds to a predetermined number of storage bins present within a typical prior art system, and can individually provide a primary input of mail pieces at a rate which corresponds to the input rate of the prior art system, then the effective number of separations or singulations that can be achieved within a single sortation pass or stage is tripled relative to the capabilities of prior art systems. Considering then the integrated constitution of the mail sorting system 510, the three mail sorting systems 110 are arranged substantially in accordance with the integrated arrangement schematically illustrated within FIG. 3 wherein two mail piece outfeed or off-shoot flow paths extend outwardly from positions disposed immediately upstream of the first input port 160 of each one of the three mail sorting systems 110, and wherein further, each one of such out-feed or off-shoot flow paths serves as a second infeed flow path into each one of the other two mail sorting systems 110. In order to distinguish the three mail sorting systems 110 from each other, it is initially noted that the three mail sorting systems have been designated as first, second, and third mail sorting systems 110-A, 110-B,110-C, and in a similar manner, in order to distinguish the principal components of each one of the first, second, and third mail sorting systems 110-A,110-B,110-C from each other, the letters A,B,C have been appended to the principal component reference character numerical designations.

More particularly, it is seen that in accordance with the illustrated multi-stage integrated mail sorting system 510, the first mail sorting system 110-A is provided with a pair of auxiliary off-shoot or outfeed conveyor flow paths 563-B, 563-C wherein upstream ends of the off-shoot or outfeed conveyor flow paths 563-B,563-C are operatively connected to the primary infeed conveyor 514-A at a position upstream of the storage bins 516-A and the first input or infeed port 560-A, and it is seen that the downstream ends of the off-shoot or outfeed conveyor flow paths 563-B,563-C are respectively operatively connected to the second and third mail sorting systems 110-B,110-C at positions upstream of their respective second input or infeed ports 562-B,562-C. In this manner, some of the articles or pieces of mail originally conveyed into the first mail sorting system 110A upon primary infeed conveyor 514-A can be immediately removed from the first primary infeed conveyor 514-A and routed to the second input or infeed ports 562-B,562-C of the primary infeed conveyors 514-B,514-C of the second and third mail sorting systems 110-B,110-C. In particular, it is further seen that the downstream ends of the off-shoot or out-feed conveyor flow paths 563-B,563-C operatively interface respectively with stacking buffers 624-B,624-C which are disposed within the second and third mail-sorting systems 110-B, 110-C at positions upstream of the second infeed or input ports 562-B,562-C.

The purpose of each one of the stacking buffers 624-A,624-B,624-C is to be capable of accumulating and stacking articles or pieces of mail coming into their particularly associated mail sorting system, that is, the first, second, and third mail-sorting systems 110-A,110-B, 110C, even if a malfunction occurs within that particular mail sorting system so as not to effectively necessitate the shut-down of the entire multi-system mail sorting system 510. In other words, if a malfunction, jam, or the like, occurs, for example, within the second mail sorting system 110-B, the stacking buffer 624-B permits the incoming mail to continue to come in from the first and third mail sorting systems 110-A,110C, to be accumulated and stacked, and to afford necessary interim time for the operator personnel to attend to and rectify the malfunction or other operational problem of the second mail sorting system 110-B. It is also of course to be appreciated that each one of the second and third mail sorting systems 110-B,110C are likewise provided with a pair of auxiliary off-shoot or outfeed conveyor flow paths 563-A,563-C, and 563-A,563-B wherein the upstream ends of the off-shoot or outfeed conveyor flow paths 563-A,563-C, and 563-A,563-B are operatively connected to the primary infeed conveyors 514-B,514-C at positions upstream of the storage bins 516-B,516-C and the first input or infeed ports 560-B,560-C, and it is seen that the downstream ends of the off-shoot or outfeed conveyor flow paths 563-A,563-C, and 563-A,563-B are respectively operatively connected to the stacking buffers 624-A,624-B,624-C of the first, second, and third mail sorting systems 110-A,110-B,110-C at positions upstream of their respective second input or infeed ports 562-A,562-B,562-C.

In any case, it is readily seen that by means of the multi-system integrated mail sorting system 510, three or more mail-sorting systems 110-A,110-B,110-C can be integrated together such that a substantially increased amount of mail pieces or articles can be processed in a readily enhanced efficient manner. It is noted further in connection with the aforenoted integration of the first, second, and third mail sorting systems 110-A,110-B,110-C, and as can readily be seen from FIG. 4, that in order to smoothly merge any two of the off-shoot or outfeed conveyor flow paths 563-A,563-B, 563-C, such as, for example, the integration or merge of the pair of first-system and third-system off-shoot or outfeed conveyor flow paths 563-B,563-B, respectively coming from the first and third mail sorting systems the stacking buffer 624-B, an adaptive merge mechanism 626-B is employed at the junction point or intersection of the pair of off-shoot or outfeed conveyor flow paths 563-B, 563-B so as to in fact achieve such merge or integration. Similar adaptive merge mechanisms 626-A and 626-C are also respectively utilized at the junctions or intersections of off-shoot or outfeed conveyor flow paths 563-A,563-A, and 563-C,563-C which respectively come from the second and third mail sorting systems 110-B,110-C. It is lastly noted that the adaptive merge mechanisms 626-A,626-B,626-C are similar to the previously disclosed conveyor adaptive merge mechanisms 190-208.

Thus, it may be seen that in accordance with the principles and teachings of the present invention, there has been disclosed a new and improved mail sorting system which is able to dramatically increase the throughput sorting volume of mail pieces or articles due to the incorporation of a plurality of cross-circulation path (CCP) conveyors within a conventional looped or folded conveyor belt system whereby, in effect, mail pieces or articles can be effectively removed from primary conveyor flow path sections so as to create gaps or spaces upon the primary conveyor flow path sections into which additional mail pieces or articles can be introduced through means of a second input or infeed port. In addition, a plurality of the new and improved mail sorting systems can be integrated together into a multi-system mail sorting system wherein off-shoot or auxiliary outfeed conveyor belt sections can feed pieces or articles of mail from any particular one of the mail sorting systems to the second input or infeed ports of the other mail sorting systems so as to render the overall system still more efficient.

From the foregoing, it is readily apparent that many variations and modifications of the present invention are possible in light of the above teachings. It is to be additionally noted, for example, that while the disclosure has illustrated the conveyor system as having a substantially oval-shaped configuration comprising an upstream conveyor flow path and a downstream conveyor flow path, other operative configurations of the conveyor, along with their associated cross-circulation path (CCP) conveyors, are possible. Three sided triangular conveyor flow paths, or four sided square or rectangular-shaped conveyor flow paths, disposed within a planar grid and with cross-circulation path (CCP) conveyors interconnecting two sides thereof, are possible, as are three-dimensional arrangements with the cross-circulation path (CCP) conveyors extending between different planar conveyor systems. It is therefore to be understood that within the scope of the appended claims, the present invention may be practiced otherwise than as specifically described herein.

What is claimed as new and desired to be protected by Letters Patent of the United States of America, is:

1. A mail sorting system for sorting articles of mail, comprising:

a first conveyor for serially conveying articles of mail, wherein said first conveyor comprises an upstream conveyor flow path and a downstream conveyor flow path separated from said upstream conveyor flow path by means of a predetermined space;

a first set of mail storage bins disposed adjacent to said upstream conveyor flow path;

a second set of mail storage bins disposed adjacent to said downstream conveyor flow path;

a first input port for serially introducing articles of mail onto said upstream conveyor flow path;

a second input port for serially introducing articles of mail onto said downstream conveyor flow path;

a plurality of cross-circulation path conveyors interconnecting said upstream conveyor flow path with said downstream conveyor flow path so as to permit articles of mail introduced onto said upstream conveyor flow path and destined for a predetermined one of said second set of mail storage bins disposed adjacent to said downstream conveyor flow path, and articles of mail introduced onto said downstream conveyor flow path and destined for a predetermined one of said first set of mail storage bins disposed adjacent to said upstream conveyor flow path, to be conveyed to said predetermined ones of said mail storage bins by means of the shortest available conveyor flow path as defined by one of said cross-circulation path conveyors; and control means for selecting a particular one of said plurality of cross-circulation path conveyors so as to ensure articles of mail introduced onto said upstream conveyor flow path and destined for a predetermined one of said second set of mail storage bins disposed adjacent to said downstream conveyor flow path, and articles of mail introduced onto said downstream conveyor flow path and destined for a predetermined one of said first set of mail storage bins disposed adjacent to said upstream conveyor flow path, will be conveyed to said predetermined ones of said destined mail storage bins by means of the shortest available conveyor flow path as defined by said particular one of said cross-circulation path conveyors selected by said control means, wherein said first conveyor, said first set of mail storage bins, said second set of mail storage bins, said first input port, said second input port, and said plurality of cross-circulation path conveyors comprise a first mail sorting system of a multi-system mail sorting system;

a second mail-sorting system comprises a respective: conveyor, a first set of mail storage bins, a second set of mail storage bins, a first input port, a second input port, and a plurality of cross-circulation path conveyors;

a third mail system comprises a respective: conveyor, a first set of mail storage bins, a second set of mail storage bins, a first input port, a second input port, and a plurality of cross-circulation path conveyors; and wherein a pair of off-shoot conveyors are connected to each one of said first, second, and third mail sorting systems, each of the pair of conveyors having upstream ends operatively connected to the upstream conveyor flow path of one of the first, second, and third mail sorting systems and downstream ends operatively connected to the downstream conveyor flow paths of the other two of the first, second, and third mail sorting systems, so as to be capable of introducing articles of mail from any one of said first, second, and third mail sorting systems into said other two of said first, second, and third mail sorting systems.

2. The mail sorting system as set forth in claim 1, wherein:

each one of said plurality of cross-circulation path conveyors comprises a multi-stage conveyor.

3. The mail sorting system as set forth in claim 1, wherein:

pairs of said cross-circulation path conveyors, interconnecting said upstream conveyor flow path with said downstream conveyor flow path, and interconnecting said downstream conveyor flow path with said upstream conveyor flow path, together comprise cross-circulation ring conveyors.

4. The mail sorting system as set forth in claim 1, further comprising:

a shunt bin operatively associated with each one of said upstream and downstream conveyor flow paths for receiving articles of mail under mail infeed overload conditions so as to permit said mail sorting system to remain functional without operationally jamming.

5. The mail sorting system as set forth in claim 1, further comprising:

a stacking buffer interposed between said downstream end of each one of said off-shoot conveyors and said second input port of each one of said downstream conveyor flow paths.

6. A mail sorting system as set forth in claim 1, further comprising:

adaptive merge mechanisms for merging any two of said off-shoot conveyors extending from any two of said first, second, and third mail sorting systems into a third one of said first, second, and third mail sorting systems.

7. The mail sorting system as set forth in claim 1, further comprising:

reader means for reading articles of mail in order to determine the destinations of the articles of mail with respect to said first set of mail storage bins disposed adjacent to said upstream conveyor flow path and said second set of mail storage bins disposed adjacent to said downstream conveyor flow path; and controller means operatively connected to said first conveyor and said plurality of cross-circulation path conveyors for controlling said first conveyor and said plurality of cross-circulation path conveyors in order to properly route the articles of mail toward their predetermined mail storage bins.

8. A mail-sorting system for sorting articles of mail, comprising:

a first conveyor for serially conveying articles of mail, wherein said first conveyor comprises an upstream conveyor flow path and a downstream conveyor flow path separated from said upstream conveyor flow path by means of a predetermined space;

a first set of mail storage bins disposed adjacent to said upstream conveyor flow path;

a second set of mail storage bins disposed adjacent to said downstream conveyor flow path;

a first input port for serially introducing articles of mail onto said upstream conveyor flow path;

a second input port for serially introducing articles of mail onto said downstream conveyor flow path;

a plurality of cross-circulation path conveyors interconnecting said upstream conveyor flow path with said downstream conveyor flow path so as to permit articles of mail, introduced onto said upstream conveyor flow path and destined for a predetermined one of said second set of mail storage bins disposed adjacent to said downstream conveyor flow path, and articles of mail, introduced onto said downstream conveyor flow path and destined for a predetermined one of said first set of mail storage bins disposed adjacent to said upstream conveyor flow path, to be conveyed to said predetermined ones of said mail storage bins by means of the shortest available conveyor flow path, as defined by one of said cross-circulation path conveyors, so as to respectively create spaces, upon said upstream and said downstream conveyor flow paths, into which additional articles of mail can be respectively introduced at said second and first input ports; and control means for selecting a particular one of said plurality of cross-circulation path conveyors so as to ensure articles of mail introduced onto said upstream conveyor flow path and destined for a predetermined one of said second set of mail storage bins disposed adjacent to said downstream conveyor flow path, and articles of mail introduced onto said downstream conveyor flow path and destined for a predetermined one of said first set of mail storage bins disposed adjacent to said upstream conveyor flow path, will be conveyed to said predetermined ones of said destined mail storage bins by means of the shortest available conveyor flow path as defined by said particular one of said cross-circulation path conveyors selected by said control means, wherein said first conveyor, said first set of mail storage bins, said second set of mail storage bins, said first input port, said second input port, and said plurality of cross-circulation path conveyors comprise a first mail sorting system of a multi-system mail sorting system;

a second mail-sorting system comprises a respective: conveyor, a first set of mail storage bins, a second set of mail storage bins, a first input port, a second input port, and a plurality of cross-circulation path conveyors;

a third mail-sorting system comprises a respective: conveyor, a first set of mail storage bins, a second set of mail storage bins, a first input port, a second input port, and a plurality of cross-circulation path conveyors; and wherein a pair of off-shoot conveyors are connected to each one of said first, second, and third mail sorting systems, each of the pair of conveyors having upstream ends operatively connected to the upstream conveyor flow path of one of the first, second, and third mail sorting systems and downstream ends operatively connected to the downstream conveyor flow paths of the other two of the first, second, and third mail sorting systems, so as to be capable of introducing articles of mail from any one of said first, second, and third mail sorting systems into said other two of said first, second, and third mail sorting systems.

9. The mail-sorting system as set forth in claim 8, wherein:

each one of said plurality of cross-circulation path conveyors comprises a multi-stage conveyor.

10. The mail-sorting system as set forth in claim 8, wherein:

pairs of said cross-circulation path conveyors, interconnecting said upstream conveyor flow path with said downstream conveyor flow path, and interconnecting said downstream conveyor flow path with said upstream conveyor flow path, together comprise cross-circulation ring conveyors.

11. The mail sorting system as set forth in claim 8, further comprising:

a shunt bin operatively associated with each one of said upstream and downstream conveyor flow paths for receiving articles of mail under mail infeed overload conditions so as to permit said mail sorting system to remain functional without operationally jamming.

12. The mail sorting system as set forth in claim 8, further comprising:

a stacking buffer interposed between said downstream end of each one of said off-shoot conveyors and said second input port of each one of said downstream conveyor flow paths.

13. A mail sorting system as set forth in claim 8, further comprising:

adaptive merge mechanisms for merging any two of said off-shoot conveyors extending from any two of said first, second, and third mail sorting systems into a third one of said first, second, and third mail sorting systems.

14. The mail sorting system as set forth in claim 8, further comprising:

reader means for reading articles of mail in order to determine the destinations of the articles of mail with respect to said first set of mail storage bins disposed adjacent to said upstream conveyor flow path and said second set of mail storage bins disposed adjacent to said downstream conveyor flow path; and controller means operatively connected to said first conveyor and said plurality of cross-circulation path conveyors for controlling said first conveyor and said plurality of cross-circulation path conveyors in order to properly route the articles of mail toward their predetermined mail storage bins.

15. A mail-sorting system for sorting articles of mail, comprising:

a first conveyor for serially conveying articles of mail, wherein said first conveyor comprises an upstream conveyor flow path and a downstream conveyor flow path separated from said upstream conveyor flow path by means of a predetermined space;

a first set of mail storage bins disposed adjacent to said upstream conveyor flow path;

a second set of mail storage bins disposed adjacent to said downstream conveyor flow path;

a first input port for serially introducing articles of mail onto said upstream conveyor flow path;

a second input port for serially introducing articles of mail onto said downstream conveyor flow path;

said upstream conveyor flow path and said first input port, and said downstream conveyor flow path and said second input port, comprising an integrated dual-input port conveyor system;

a plurality of cross-circulation path conveyors interconnecting said upstream conveyor flow path with said downstream conveyor flow path so as to permit articles of mail, introduced onto said upstream conveyor flow path and destined for a predetermined one of said second set of mail storage bins disposed adjacent to said downstream conveyor flow path, and articles of mail, introduced onto said downstream conveyor flow path and destined for a predetermined one of said first set of mail storage bins disposed adjacent to said upstream conveyor flow path, to be conveyed to said predetermined ones of said mail storage bins by means of the shortest available conveyor flow path, as defined by one of said cross-circulation path conveyors, and to respectively create spaces, upon said upstream and said downstream conveyor flow paths, into which additional articles of mail can be respectively introduced at said second and first input ports; and control means for selecting a particular one of said plurality of cross-circulation path conveyors so as to ensure articles of mail introduced onto said upstream conveyor flow path and destined for a predetermined one of said second set of mail storage bins disposed adjacent to said downstream conveyor flow path, and articles of mail introduced onto said downstream conveyor flow path and destined for a predetermined one of said first set of mail storage bins disposed adjacent to said upstream conveyor flow path, will be conveyed to said predetermined ones of said destined mail storage bins by means of the shortest available conveyor flow path as defined by said particular one of said cross-circulation path conveyors selected by said control means wherein said first conveyor, said first set of mail storage bins, said second set of mail storage bins, said first input port, said second input port, and said plurality of cross-circulation path conveyors comprise a first mail sorting system of a multi-system mail sorting system;

a second mail-sorting system comprises a respective: conveyor, a first set of mail storage bins, a second set of mail storage bins, a first input port, a second input port, and a plurality of cross-circulation path conveyors;

a third mail-sorting system comprises a respective: conveyor, a first set of mail storage bins, a second set of mail storage bins, a first input port, a second input port, and a plurality of cross-circulation path conveyors; and wherein a pair of off-shoot conveyors are connected to each one of said first, second, and third mail sorting systems, each of the pair of conveyors having upstream ends operatively connected to the upstream conveyor flow path of one of the first, second, and third mail sorting systems and downstream ends operatively connected to the downstream conveyor flow paths of the other two of the first, second, and third mail sorting systems, so as to be capable of introducing articles of mail from any one of said first, second, and third mail sorting systems into said other two of said first, second, and third mail sorting systems.

16. The mail-sorting system as set forth in claim 15, wherein:

each one of said plurality of cross-circulation path conveyors comprises a multi-stage conveyor.

17. The mail-sorting system as set forth in claim 15, wherein:

pairs of said cross-circulation path conveyors, interconnecting said upstream conveyor flow path with said downstream conveyor flow path, and interconnecting said downstream conveyor flow path with said upstream conveyor flow path, together comprise cross-circulation ring conveyors.

18. The mail sorting system as set forth in claim 15, further comprising:

a shunt bin operatively associated with each one of said upstream and downstream conveyor flow paths for receiving articles of mail under mail in feed overload conditions so as to permit said mail sorting system to remain functional without operationally jamming.

19. The mail sorting system as set forth in claim 15, further comprising:

a stacking buffer interposed between said downstream end of each one of said off-shoot conveyors and said second input port of each one of said downstream conveyor flow paths.

20. The mail sorting system as set forth in claim 15, further comprising:

adaptive merge mechanisms for merging any two of said off-shoot conveyors extending from any two of said first, second, and third mail sorting systems into a third one of said first, second, and third mail sorting systems.

21. The mail sorting system as set forth in claim 15, further comprising:

reader means for reading articles of mail in order to determine the destinations of the articles of mail with respect to said first set of mail storage bins disposed adjacent to said upstream conveyor flow path and said second set of mail storage bins disposed adjacent to said downstream conveyor flow path; and controller means operatively connected to said first conveyor and said plurality of cross-circulation path conveyors for controlling said first conveyor and said plurality of cross-circulation path conveyors in order to properly route the articles of mail toward their predetermined mail storage bins.

* * * * *